United States Patent [19]

Cooke

[11] 4,454,974

[45] Jun. 19, 1984

[54] PAPER TOWEL REGULATOR AND DISPENSER

[75] Inventor: Allister B. Cooke, Santa Barbara, Calif.

[73] Assignee: CCT Associates, Bethesda, Md.

[21] Appl. No.: 369,002

[22] Filed: Apr. 16, 1982

[51] Int. Cl.[3] ..... B26F 3/02; B65H 35/10

[52] U.S. Cl. ..... 225/106; 225/89; 225/74; 242/55.2

[58] Field of Search ..... 242/55.2, 55.3, 55.53, 242/55.54, 75, 75.2; 226/195; 225/46, 47, 12–14, 82, 84, 72–74, 89, 16

[56] References Cited

U.S. PATENT DOCUMENTS

| | | | |
|---|---|---|---|
| 1,027,331 | 5/1912 | Hargis et al. | 225/13 |
| 2,161,415 | 6/1939 | Harrison et al. | 225/13 |
| 2,324,796 | 7/1943 | Neptune | 242/55.2 |
| 3,190,520 | 6/1965 | Wyant | 225/89 X |
| 4,354,643 | 10/1982 | Kenner | 242/55.2 |

FOREIGN PATENT DOCUMENTS

| | | | |
|---|---|---|---|
| 2818347 | 11/1978 | Fed. Rep. of Germany | 225/84 |

*Primary Examiner*—Leonard D. Christian
*Attorney, Agent, or Firm*—Cantor and Lessler

[57] ABSTRACT

A paper towel dispenser and regulator using a compound lever arrangement. The lever arrangement includes a counterbalanced lever bar at one end and friction pads at the other end, the friction pads bearing against a friction beam over which the paper towels coming from the roll pass.

18 Claims, 10 Drawing Figures

PAPER TOWEL REGULATOR AND DISPENSER

BACKGROUND OF THE INVENTION

This invention broadly relates to dispensers, and more particularly, this invention relates to a regulator and a dispenser for paper towels.

One of the most common household items is the ubiquitous paper towel roll. Rolls of paper towels are commonly found in the kitchen as well as other work areas of the home, to say nothing of commercial uses. A roll of paper towels is typically between 11 and 12 inches in width and consists of a roll of several hundred towels separated by perforations. The roll is wound on a cardboard core.

It is possible that the roll can be left loose on a counter and picked up, and the desired number of towels torn off the roll manually. More common, however, is the mounting of the roll of paper towels in a simple dispenser which has a pair of spaced apart end pieces which clamp over the hollow core and allow the user to grip the leading towel on the roll and pull a length of paper toweling off the roll, after which they are torn off at a perforation by a sudden hard jerk or by holding the towels on either side of a perforation with both hands and tearing at the perforation. Most such dispensers are inexpensive and, in fact, cheaply made. They grip the roll with sufficient pressure to hold it in place, but loosely enough to allow for easy rolling. In fact, the rolling is so easy that a pull on the leading towel almost inevitably causes the unrolling of a greater length of toweling than the user desires. Then, when the toweling is jerked to tear it off the roll, the roll continues to turn, resulting in a length of paper toweling dangling from the holder. The user is then forced to manually turn the roll back in the other direction to re-wind the length of towels.

Alternatively, the user pulls the desired length of towels off the roll with one hand and then holds the roll stationary with the other hand while tearing off the desired length. This is extremely inconvenient when the user is working at some task and may have his hands wet or otherwise occupied.

Accordingly, there exists a need for a regulator for a paper towel dispenser that would allow the easy dispensing of a desired length of paper towels and the easy tearing off of the desired length of paper towels with only one hand. Similarly, the need exists for a complete dispenser which embodies such a regulator.

BRIEF SUMMARY OF THE INVENTION

It is, therefore, the primary object of the present invention to provide a paper towel regulator and dispenser which is free of the aforementioned and other such desiderata.

It is another object of the present invention to provide a paper towel regulator which is easy to operate.

It is still another object of the present invention to provide a paper towel regulator which allows for the easy unrolling of a desired length of paper towels from a roll and then holds the roll stationary to tear off the desired length of paper towels.

It is yet another object of the present invention to provide a paper towel regulator which is easy and inexpensive to manufacture.

It is still a further object of the present invention, consistent with the foregoing objects, to provide a paper towel dispenser which will hold a paper towel roll for easy dispensing and regulate the dispensation of the paper towels.

Consistent with the objects, the paper towel regulator of this invention comprises:

(A) mounting bracket means;

(B) a friction beam fixed to the bracket means and disposed in the dispensing path of the paper towels and transverse to the same;

(C) a lever bar assembly mounted in the bracket means and having an elongated first bar portion disposed transverse to the path, an arm at each end of the bar portion extending parallel to the path, and a second bar portion disposed transverse to the path at the ends of the arms;

(D) friction pad means fixed to the second bar portion;

(E) the lever bar assembly being pivotally mounted to the bracket means with the fulcrum being so disposed along the arm that the assembly is normally counterbalanced with the first bar portion hanging downwardly and, when the first bar portion is pivoted upwardly, the friction pad means contacts the friction beam;

(F) whereby when the paper towels coming off the roll, which have been threaded over the friction beam and under the first bar portion, are pulled downwardly, they freely unroll, but when they are pulled upwardly they contact the first bar portion pivoting the same upwardly and pivoting the friction pad means downwardly to form a nip with the friction beam, thereby clamping the paper towels to prevent unrolling and allow tearing the same off the roll.

BRIEF DESCRIPTION OF THE DRAWINGS

The invention will be better understood, and objects other than those set forth above will become apparent, when consideration is given to the following detailed description thereof. Such description makes reference to the annexed drawings wherein.

DETAILED DESCRIPTION OF THE PREFERRED EMBODIMENTS

Figure 1:
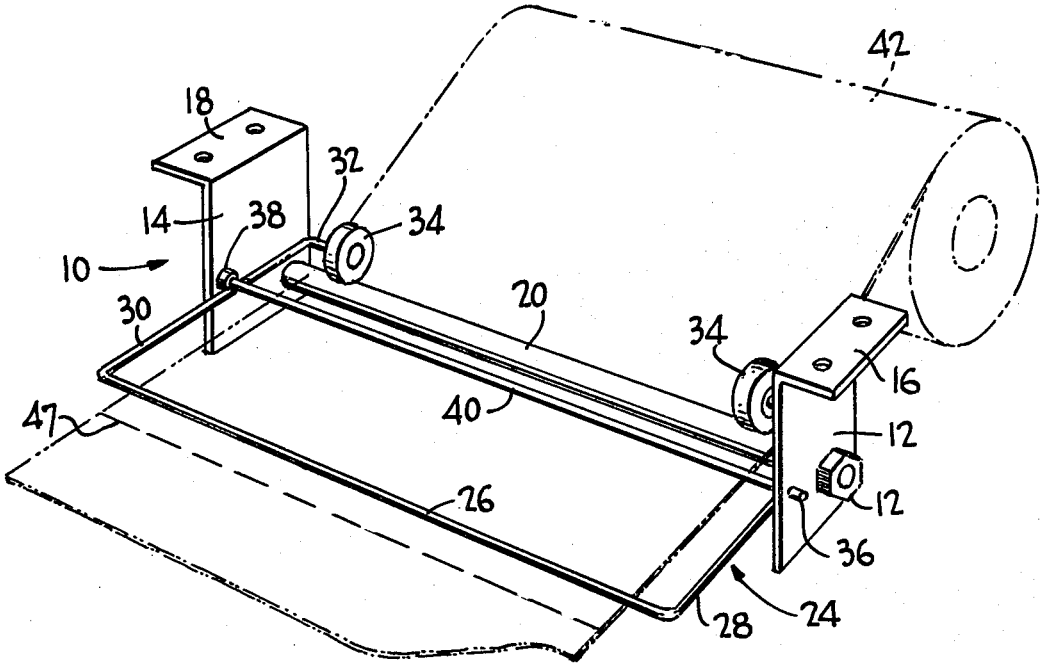
FIG. 1 is a perspective view of one embodiment of the paper towel regulator of this invention adapted for mounting to a horizontal surface.
Figure 1A:
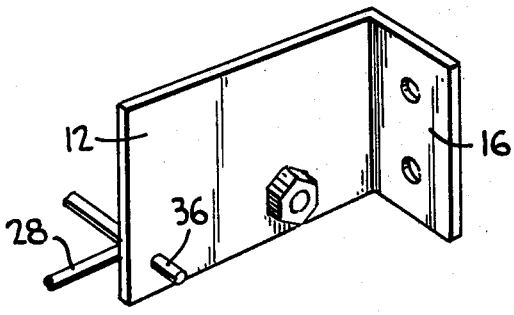
FIG. 1A is a perspective view of a mounting for the embodiment of FIG. 1 adapted for mounting on a vertical surface.

Referring first to FIG. 1, there is shown the paper towel regulator of the instant invention generally designated by the numeral 10. The regulator 10 comprises mounting means which, in this embodiment, itself comprises a pair of mounting brackets 12 and 14 which are simply L brackets with the base of the L drilled for mounting on a horizontal surface such as, for example, the bottom of a typical kitchen cabinet using screws or the like. Alternatively, if the regulator were to be mounted on a vertical surface, the base portions 16 and 18 of brackets 12 and 14 would be on the rear edge of the brackets instead of on the top as shown in FIG. 1A.

Mounted in brackets 12 and 14 is friction beam 20. Friction beam 20 is fixed to the mounting brackets by any suitable means well-known in the art. In the embodiment shown in FIG. 1, the ends of friction beam 20 are threaded, passed through a hole in the mounting brackets, and secured by a nut 22. It is to be distinctly understood, however, that this mounting means is shown for exemplary purposes only and the invention is not limited thereto. Also mounted to brackets 12 and 14 is a lever bar assembly generally designated by the numeral 24. Lever bar assembly can be considered to be generally "C" shaped with base portion 26 spanning the path of the paper towels as they unwind from the roll, and a pair of arms 28 and 30 projecting from bar 26 and terminating, at their other ends, in fingers 32. Fixed to the ends of fingers 32 are friction pads 34. The lever bar assembly 24 is pivotally mounted to mounting brackets 12 and 14 at pivots 36 and 38. While lever bar assembly 24 is shown as including an axle member 40 whose end portions pass through mounting brackets 12 and 14 to provide the pivots, it will be apparent to those skilled in the art that the central portion of axle 40 may be omitted, leaving only the end portions. The central portion of axle 40, however, provides structural reinforcement to the lever arm 24, preventing arm portions 28 and 30 from flexing, and is desirable. It will be seen that as paper towels are pulled from roll 42, they pass over friction beam 20 and under friction pads 34, that is, between the friction pads 34 and friction beam 20. The paper towels from the roll then pass under the lever bar 26.

Figure 2:
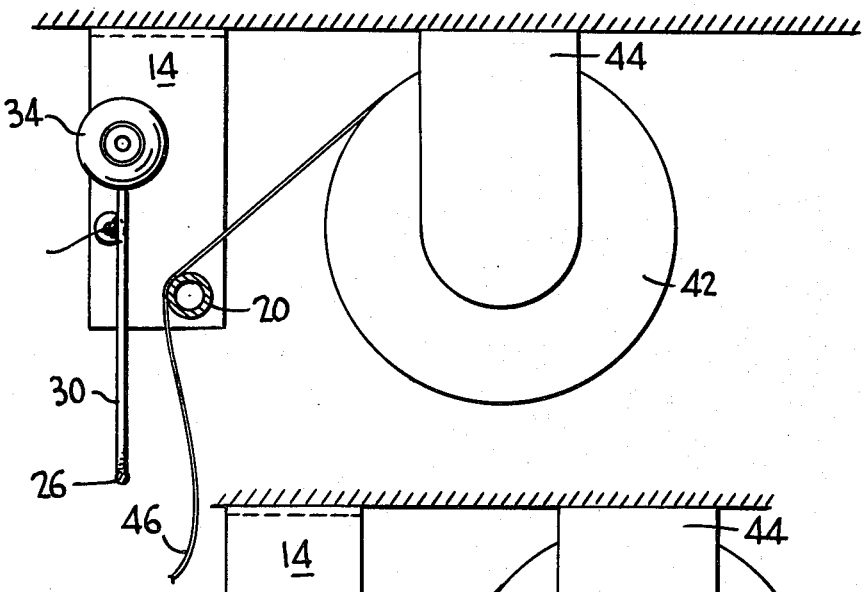
FIG. 2 is an end view of the regulator of FIG. 1, partly in cross-section for illustrative clarity, showing the regulator in the dispensing position and showing a paper towel roll in position.

Attention is now directed to FIG. 2 showing the paper towel roll 42 mounted on a typical prior art mounting bracket 44. The regulator 10 is shown with the lever bar assembly in its normal position, being counterbalanced with lever bar 26 depending downwardly from the fulcrum 36 and 38, and friction pads 34 being raised out of contact with friction beam 20. In this position, paper towels may be easily pulled from the roll 42 until the desired length is off the roll.

Figure 3:
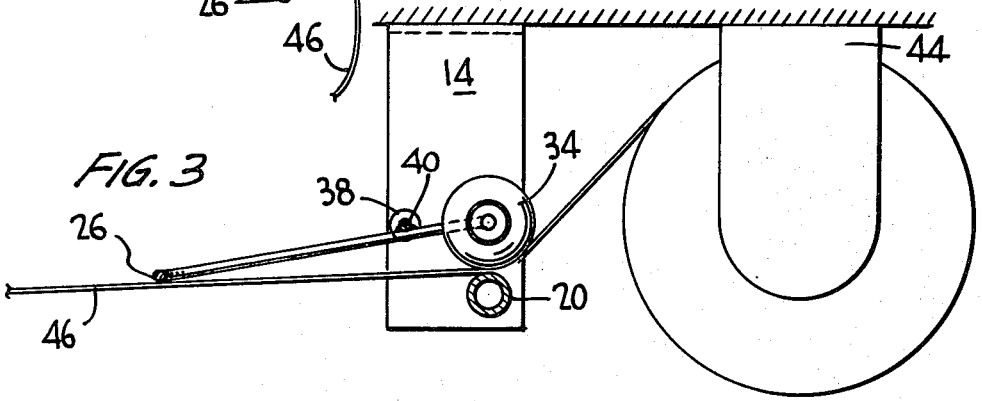
FIG. 3 is an end view of the regulator shown in FIG. 2 with the regulator in the tearing position.

Turning now to FIG. 3, when it is desired to tear a length of paper towels from the roll, the user pulls the free end 46 from the paper towel roll upwardly, contacting lever bar 26 and moving it upwardly, thereby pivoting the lever bar assembly about pivots 36 and 38 to bring friction pads 34 down against friction beam 20, thereby clamping the paper towels between the friction pads 34 and the friction beam 20. A further upward pull on the free end 46 of the paper towel roll causes it to tear off at the perforation 47 (FIG. 1) next outside the lever bar 26.

In the embodiment shown in FIGS. 1 through 3, all the elements of the regulator, except for friction pads 34 which are made of rubber, or the like, are made of any suitable metal such as steel, aluminum, or some combination thereof. It is to be distinctly understood that the material of which these elements are manufactured is not critical to this invention. In fact, the elements may be made of any material suitable for such use, such materials being well-known in the art. Typically, in a commercial embodiment, one or more elements would be made of a suitable plastic. Similarly, where a particular joining or mounting means is illustrated for exemplary purposes, any equivalent such joining or mounting means could be used. Furthermore, especially when a plastic is used, one or more elements could be made integral with each other without departing from the spirit or scope of the invention.

Figure 4:
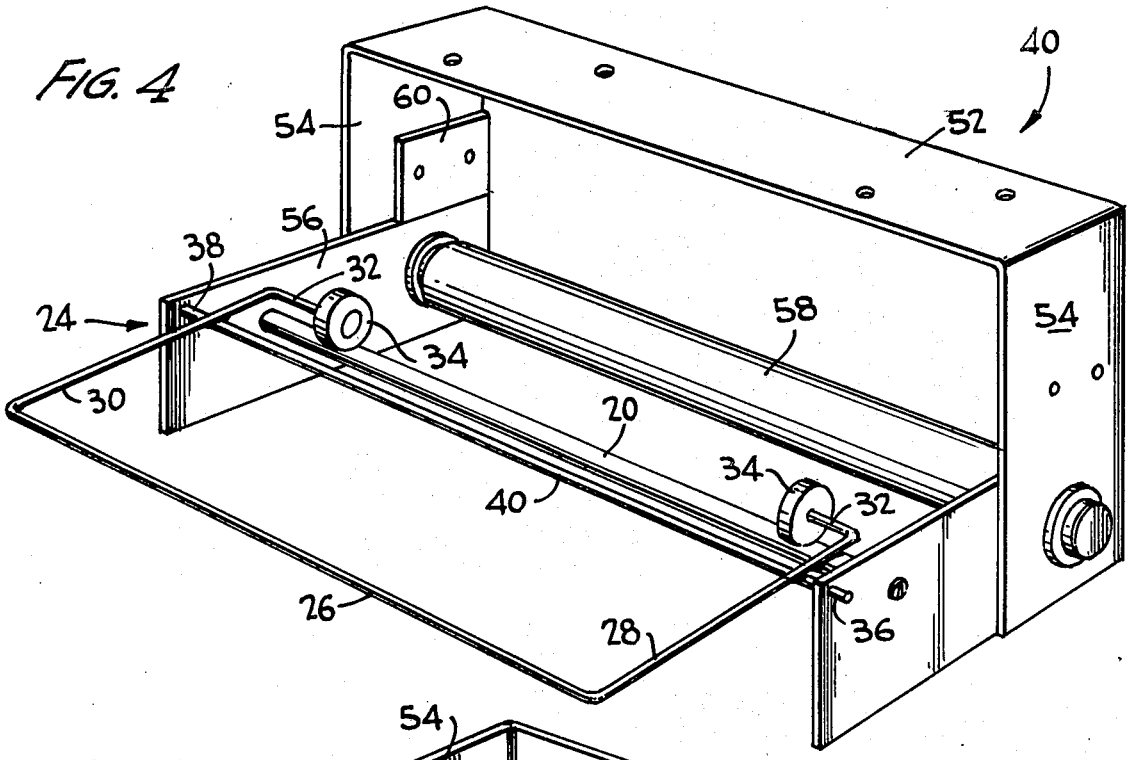
FIG. 4 is a perspective view of the paper towel dispenser of the present invention, as adapted for mounting to a horizontal surface.

Attention is now directed to FIG. 4 showing a paper towel dispenser generally designated by the numeral 48 and embodying the regulator 24 of this invention. It is to be noted that like numerals designate like elements in the drawings. Paper towel dispenser 48 comprises mounting means for both a paper towel roll and the regulator. The mounting means includes a bracket 50 which comprises a base portion 52 and a pair of depending arm portions 54. Base portion 52 of the bracket is drilled for mounting to a horizontal surface by means of screws or the like with the arm portions 54 then depending therefrom. Fixed to arm portions 54 are side plates 56, the manner of fixing the side plates 56 to arm portions 54 being described more fully hereinbelow. A spindle 58 for holding a paper towel roll is mounted through side plates 56. In this preferred embodiment, the spindle 58 actually mounts through both side plates 56 and arm portions 54. Regulator 24 is also mounted to side plates 56.

Figure 5:
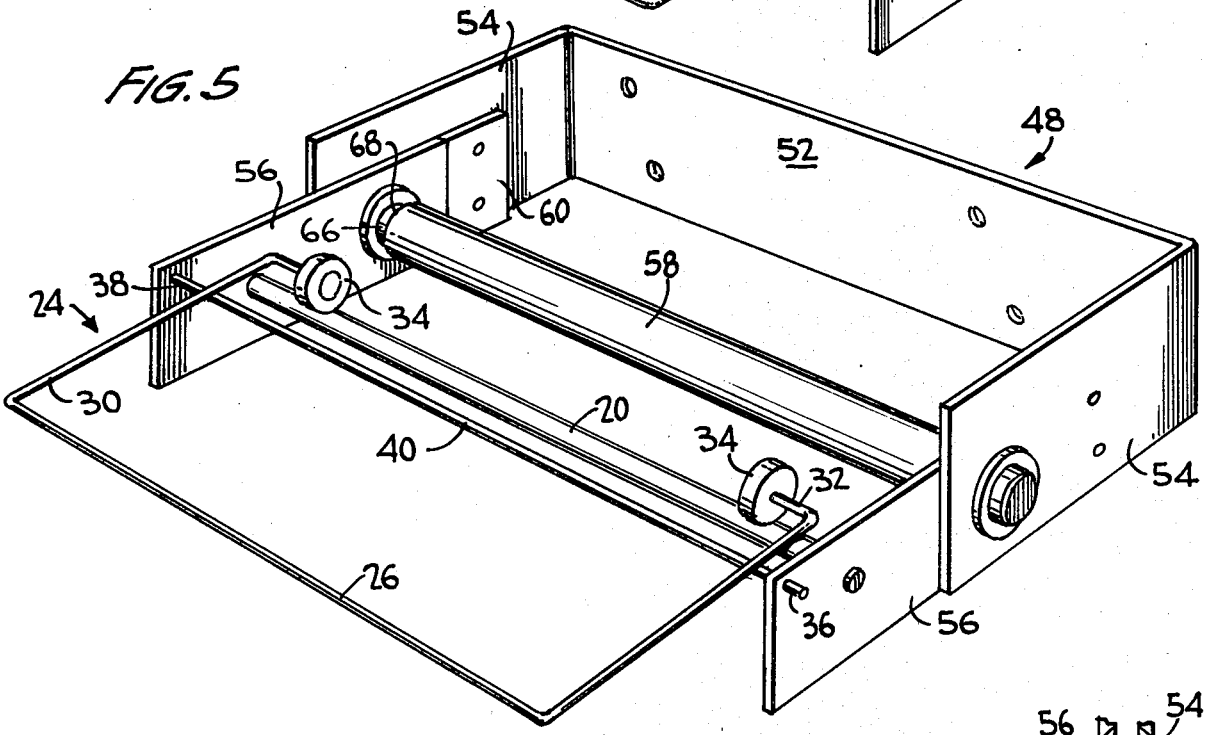
FIG. 5 is a perspective view of the dispenser of FIG. 4, adapted to be mounted to a vertical surface.

In FIG. 5 there is shown the same dispenser as in FIG. 4, but adapted for mounting to a vertical surface such as a wall. In this instance, arms 54 extend outwardly and side plates 56 extend further outwardly, whereas in the embodiment of FIG. 4, arm portions 54 extend downwardly and side plates 56 extend outwardly. In both figures there are seen stop plates 60 fixed to arm portions 54 and positioned such that when the dispenser is mounted on a horizontal surface, the rear portion of the upper side of side plate 56 butts against stop plate 60. On the other hand, when the dispenser is mounted to a vertical surface, the rear end of side plate 56 butts against stop plate 60.

Figure 6:
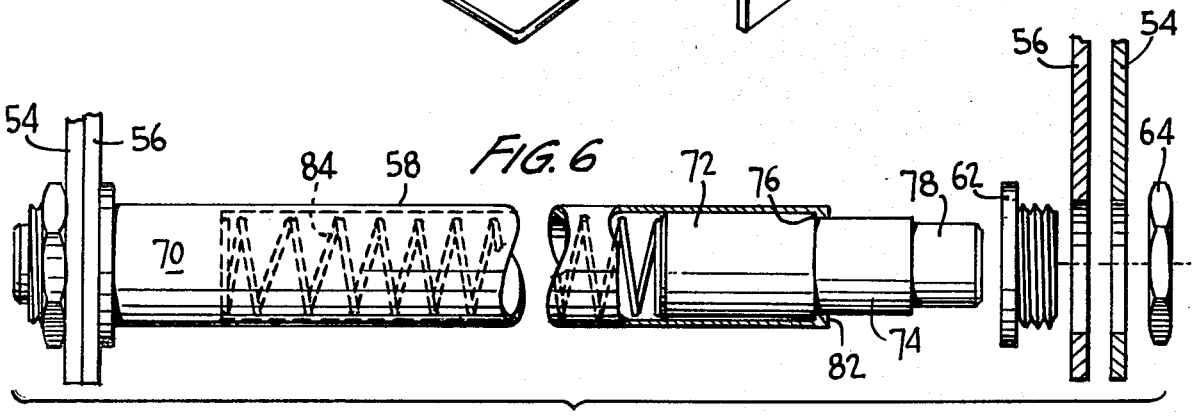
FIG. 6 is an elevational view of the paper towel holding means, partly in cross-section, and partly fragmented for illustrative clarity.

For an understanding of the actual mounting of side plates 56 to arm portions 54, and of spindle 58 to the bracket, attention is directed to FIG. 6. Specifically, toward the right side of FIG. 6, arm portion 54, side plate 56, and the joining means are shown in an exploded manner. The joining means comprises a threaded hollow collar 62 which passes through juxtaposed holes in arm portion 54 and side plate 56, and the complete assembly then held together by nut 64. The assembly of collar 62 and nut 64 forms a bushing into which a reduced end portion of spindle 58 is inserted for rotational movement. The reduced end portion is shown in FIG. 5 at 66. The reduced end portion 66 is of such a diameter that it passes through the bushing formed by collar 62 and forms a shoulder 68 with the main body portion of spindle 58 to prevent the complete spindle from slipping through the bushing. In the preferred embodiment, spindle 58 is a hollow aluminum tube with a solid aluminum plug 70 press fit into one end, this plug 70 being stepped to form the reduced diameter portion 66. In the other end of spindle 58 is another solid aluminum plug 72 which, however, is slidingly mounted for axial movement in spindle 58. Plug 72 is stepped to form an intermediate reduced portion 74 and shoulder 76, and a reduced diameter end portion 78 and shoulder 80. The end of spindle 58 is slightly closed or compressed at 82 to form a stop against which shoulder 76 bears to prevent plug 72 from coming out of spindle 58. Plug 72 is normally biased outwardly by a spring 84. Thus, after the bracket is mounted to either a horizontal or a vertical surface, end plates 56 are then mounted to arm portions 54 as shown in either FIG. 4 or FIG. 5, using collar 62 and nut 64. Spindle 58 is inserted in a paper towel roll and then inserted in the bushings formed by the collars 62 by pushing plug 72 inwardly, engaging reduced diameter end portion 66 in one bushing, and then allowing plug 72 to move outwardly and engage reduced diameter end portion 78 in the other bushing. The diameters of end portions 66 and 78 are the same.

Figure 7:
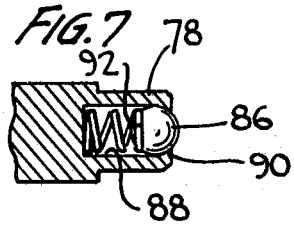
FIG. 7 is a vertical cross-sectional view of another embodiment of one portion of the means shown in FIG. 6.

Since bushings 62 form a slight shoulder over which the end portions of spindle 58 must move immediately prior to insertion into the bushings, it may be helpful to provide the end portions which a further compressible portion as shown in FIG. 7. In this embodiment, a ball bearing member 86 is inserted in a bore 88 and held in place against removal by lip portion 90. Ball bearing member 86 is biased outwardly by spring 92. Thus, when the end of spindle 58 is pushed against the shoulder formed by collar 62, the ball bearing member 86 is pushed inwardly and rolls over the surface of the shoulder. It will be appreciated that the springs 92 and 84 will be chosen such that ball 86 will not move completely into cavity 88 before plug 72 starts to slide into spindle 70. In other words, the force of spring 92 is such that ball 86 always protrudes, at least slightly from the end of the plug. The ball then springs out again when the end portions of spindle 58 are inserted into the bushings. On the other hand, if means for joining members 54 and 56 and holding spindle 58 are used which do not have a shoulder, the further compressible portion is not necessary.

Figure 8:
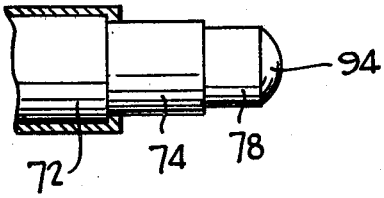
FIG. 8 is an elevational view, partly in cross-section, of an alternate embodiment of the means shown in FIGS. 6 and 7.

As an alternate embodiment to the compressible ball end portion of FIG. 7, a rounded end portion as shown at 94 in FIG. 8 can be used.

Figure 9:
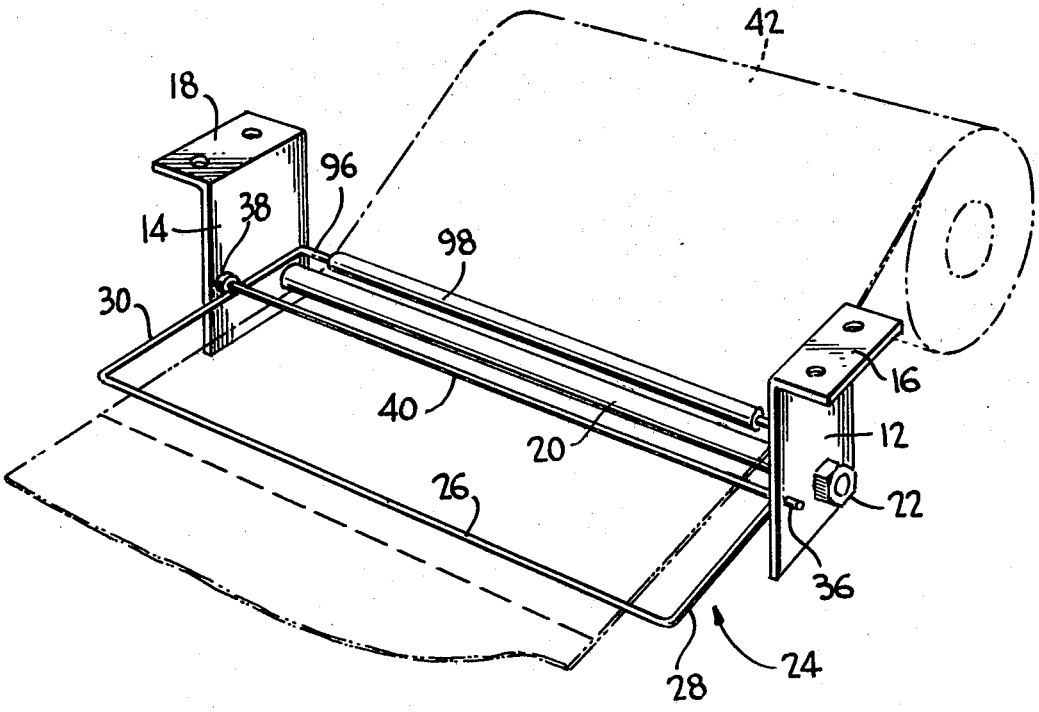
FIG. 9 is a perspective view of still another embodiment of the regulator of this invention.

Turning to FIG. 9, still another embodiment is shown wherein, instead of fingers 32 and friction pads 34, there is provided a bar 96 spanning the full distance between arms 28 and 30 and a friction surface 98 could be a suitable rubber or plastic sleeve surrounding bar 96 or it could be a suitable rubber or plastic coating applied by spraying or dipping. The friction surface could cover essentially the whole length of bar 96 as shown in FIG. 8, or it could be applied only to selected portions. This embodiment is particularly suitable when using paper towels of a low quality where the force required to tear at a perforation is close to that required to tear the paper per se. The gripping force applied by the friction surface against the friction bar is more uniform than when friction pads are used.

Again, in the embodiment of the invention shown in FIGS. 4 through 9, particular materials of construction are shown and described. It will be appreciated by those skilled in the art that these materials of construction may vary for purposes of manufacture, economy, and aesthetics.

Thus, it can be seen that the objects set forth at the outset have been successfully achieved. Since many embodiments may be made of the instant inventive concepts, and since many modifications may be made of the embodiments hereinbefore described, it is to be understood that all matter herein is to be interpreted merely as illustrative and not in a limiting sense.

What is claimed is:

1. A paper towel regulator adapted for mounting in close proximity to a paper towel roll and in the dispensing path thereof, said regulator comprising:

(A) mounting bracket means;

(B) a friction beam fixed to said mounting bracket means and disposed in said path transverse to said paper towels;

(C) a lever bar assembly mounted in said mounting bracket means and having an elongated bar portion disposed transverse to said path, an arm at each end of said bar portion extending parallel to said path, and a second bar means at the end of the arms;

(D) friction pad means fixed to said second bar means;

(E) said lever bar assembly being pivotally mounted in said mounting bracket means with the fulcrum being so disposed along said arms that said assembly is normally counterbalanced with said bar portion hanging downwardly and, when said bar portion is pivoted upwardly, said friction pad means contacts said friction beam;

(F) whereby when said paper towels coming off said roll, which have been threaded over said friction beam and under said bar portion, are pulled downwardly, they freely unroll, but when they are pulled upwardly they contact said bar portion pivoting the same upwardly and pivoting said friction pad means downwardly to form a nip with said friction beam, thereby clamping said paper towels to prevent unrolling and allow tearing the same off the roll.

2. A paper towel regulator as defined in claim 1, wherein said mounting bracket means comprises a pair of spaced apart brackets which are adapted to depend vertically from a horizontal support surface.

3. A paper towel regulator as defined in claim 1, wherein said mounting bracket means comprises a pair of spaced apart brackets which are adapted to extend horizontally from a vertical support surface.

4. A paper towel regulator as defined in claim 1, in combination with means for mounting a paper towel roll to dispense said paper towels in said path.

5. A paper towel regulator as defined in claim 1, 2, 3, or 4, wherein said second bar means comprises an inwardly directed finger at the end of each said arm and said friction pad means is a friction pad fixed to each said finger.

6. A paper towel regulator as defined in claim 1, 2, 3, or 4, wherein said second bar means comprises an elongated bar disposed transverse to said path and having a friction surface on at least a part of its length.

7. A paper towel regulator as defined in claim 6, wherein said friction surface comprises a sleeve.

8. The combination defined in claim 4, further comprising a paper towel roll mounted on said holder means.

9. A paper towel dispenser comprising the paper towel regulator defined in claim 1 and means for holding a paper towel roll wherein:

(A) said mounting bracket means comprises:

(a) a bracket member having an elongated base portion and an extending arm portion at each end thereof, and (b) a side plate removably attached to each arm portion.

(B) said means for holding a paper towel roll is removably and rotatably mounted in said side plates;

(C) said friction beam is fixedly mounted to said side plates; and (D) said lever bar assembly is pivotally mounted in said side plates.

10. A paper towel dispenser as defined in claim 9, wherein said mounting bracket means further comprises stop means fixed to each said arm portion against which said side plates butt to assure proper placement and alignment.

11. A paper towel dispenser as defined in claim 10, wherein said base portion is mounted to a horizontal surface, said arm portions depend from said base portion, and said side plates are mounted to said arm portions to extend horizontally therefrom.

12. A paper towel dispenser as defined in claim 10, wherein said base portion is mounted to a vertical surface, said arm portions extend horizontally from said base portion, and said side plates are mounted to said side portions to extend horizontally therefrom.

13. A paper towel dispenser as defined in claim 9, 10, 11, or 12, wherein said plates are removably affixed to said arm portions by means of removable bushings and said paper towel roll holding means is rotatably mounted in said bushings.

14. A paper towel dispenser as defined in claim 13, wherein said means for holding a paper towel roll comprises a spindle having a diameter smaller than that of the core of a paper towel roll but larger than that of the inner diameter of said bushings; having a reduced diameter portion at one end thereof, said end having a diameter smaller than said inner diameter of said bushing, thereby forming a shoulder loosely butting against said bushing; and having an axially movable stud slidably mounted in the other end thereof and normally biased outwardly, said stud having a reduced diameter portion at the outer end thereof, said last-mentioned reduced diameter portion having a diameter smaller than said inner diameter of said bushing, thereby forming a shoulder loosely butting against said bushing.

15. A paper towel dispenser as defined in claim 14, wherein said stud further comprises a ball bearing member mounted for axle movement in the outer end thereof and protruding therethrough, said ball bearing member being normally biased outwardly.

16. A paper towel dispenser as defined in claim 9, 10, 11, or 12, wherein said second bar means comprises an inwardly directed finger at the end of each said arm and said friction pad means is a friction pad fixed to each said finger.

17. A paper towel dispenser as defined in claim 9, 10, 11, or 12, wherein said second bar means comprises an elongated bar disposed transverse to said path and having a friction surface on at least a part of its length.

18. A paper towel dispenser as defined in claim 17, wherein said friction surface comprises a sleeve.

* * * * *